United States Patent [19]

Lunde

[11] Patent Number: 4,549,526

[45] Date of Patent: Oct. 29, 1985

[54] COMBINATION WOOD-FIRED BOILER AND STORAGE APPARATUS

[75] Inventor: Martin R. Lunde, Minneapolis, Minn.

[73] Assignee: Garn, Incorporated, Saint Paul, Minn.

[21] Appl. No.: 480,922

[22] Filed: Mar. 31, 1983

[51] Int. Cl.[4] ..... F24B 9/00

[52] U.S. Cl. ..... 126/367; 126/368

[58] Field of Search ..... 126/360 R, 366, 367, 126/368, 347, 343.5 R, 343.5 A, 77; 122/10, 20 B, 49, 52, 87, 101, 22, 23, 211, 15; 237/57, 59; 110/26

[56] References Cited

U.S. PATENT DOCUMENTS

| | | | |
|---|---|---|---|
| Re. 24,295 | 3/1957 | Johnson | 126/367 X |
| 159,103 | 1/1875 | Latta | 126/368 |
| 163,735 | 5/1875 | Busch | 126/368 |
| 1,383,530 | 7/1921 | Cotton | 126/347 |
| 1,992,468 | 2/1935 | Bradley | 126/367 |
| 2,179,131 | 11/1939 | Millard | 126/368 X |
| 2,242,744 | 5/1941 | Close | 122/101 X |
| 2,495,673 | 1/1950 | Erwin | 126/366 X |
| 2,655,144 | 10/1953 | Keating | 126/360 R X |
| 3,718,131 | 2/1973 | Busse et al. | 431/5 X |
| 4,401,101 | 8/1983 | Lunde | 126/368 X |
| 4,421,064 | 12/1983 | Lehtinen | 122/22 X |
| 4,432,339 | 2/1984 | Hebert | 126/368 |

OTHER PUBLICATIONS

*Chemical Engineering,* vol. 85, No. 12, Nov. 6, 1978, "Fluidized Bed Boiler Can Accept Many Fuels", pp. 91–92.

*Primary Examiner*—Randall L. Green

*Attorney, Agent, or Firm*—Dorsey & Whitney

[57] ABSTRACT

The application discloses improvements in a combination solid-fuel-burning, liquid heating and thermal energy storage apparatus in which a firebox is immersed in a large tank for heating the liquid stored therein and in which an improved flue assembly carries gaseous combustion products from the firebox through the tank liquid to an exhaust stack which has an outlet outside the tank. A blower draws combustion air into the firebox, draws the resulting gaseous combustion products through the flue assembly and provides a forced discharge of said combustion products through the stack outlet. The blower preferably includes a rotary fan in a fan housing which is serially connected in the flue assembly and positioned within the liquid inside the tank to provide a heat exchange housing enhancing the transfer of thermal energy from the combustion products to the surrounding tank liquid and minimizing possible high temperature damage to and excessive wear of the blower parts. Other improvements in the flue assembly members, the constantly open venting means, the firebox construction and other parts of the apparatus are also disclosed.

17 Claims, 11 Drawing Figures

2
60
52
11
47
46
54
53
48
51
17
21
14
59
86
49
22
62
32
31
61
26
57
34
27
36
33
39
40
28
15
37
44
78
24
29
38
42
58
56
55
41
23
43
3
3
79
68
14
71
73
72
63
66
67
65
16
12
13
2

47
52
46
48
53
111
59
17
11
12
61
32
36
57
19
27
18
24
29
58
78
56
79
66
64
65
13
13
63
16

COMBINATION WOOD-FIRED BOILER AND STORAGE APPARATUS

BACKGROUND OF THE INVENTION

This invention relates generally to improved apparatus for heating liquids to provide thermal energy for the heating of room spaces and other uses.

In some prior liquid heating devices, blowers have been used to obtain the desired supply of fuel and/or combustion air in an effort to achieve hotter combustion temperatures, more rapid and complete burning of the fuel or other objectives. If such a blower is connected to the inlet door of a combustion chamber or firebox, however, it produces a positive pressure within the firebox. Such pressure can result in outward leakage of hot gaseous combustion products around such a door and can cause a dangerous discharge of such products, if an operator inadvertently opens the door without first shutting off the blower. If the blower is connected to the end of a final outlet stack from such a firebox, so that it tends to establish a negative pressure at the firebox door, the dangerous leakage can be avoided. In either case, however, I have recognized that the blower contributes primarily to the movement of air or gaseous combustion products through the system and not to the transfer of thermal energy from such combustion products to the liquid in the tank. In fact the blower may speed up such movement and tend to remove the hot gaseous products, before there is an adequate opportunity to transfer their thermal energy to the liquid in the tank.

In prior liquid heating devices in which the desired heat is obtained by the burning of solid fuels such as wood or other chunk fuels, I have found that there can be problems of inefficient or inadequate combustion, both during the start-up of combustion after a fire is ignited and during the subsequent burning of a load of solid fuel. In cases where at least part of a firebox or combustion chamber wall is in direct contact with the liquid to be heated, as is the case in almost any wood-fired tank or boiler, the liquid around the outside of the firebox can have a cooling or chilling effect on the firebox wall temperature, thus interfering with the achievement of efficient flame combustion temperatures in the range of 1600 degrees to 2000 degrees F. (Fahrenheit). Below such temperatures, incomplete combustion occurs resulting in creosote and particulate formation, which immediately deposit upon the cool firebox wall. Wood-fired tanks or boilers are therefore often thought of as undesirable sources of thermal energy which contribute a high proportion of pollutants to the surrounding atmosphere and which do not even achieve a relatively efficient heat transfer to the liquid in such a tank or boiler, i.e. a transfer of relatively high percentages of the available thermal energy which is stored within the wood or other chunk fuel.

While the present invention involves a recognition and possible solution of these and other problems in connection with liquid heating tanks and boilers in general, as well as in connection with the heating of such tanks and boilers by the burning of solid or chunk fuels such as wood, cob corn, briquettes, etc., I have found that the features of this invention provide special advantages in the novel type of solid-fuel burning apparatus described and claimed in my prior patent application Ser. No. 325,766, filed Nov. 27, 1981 (now issued as U.S. Pat. No. 4,401,101), which was a continuation in part of application Ser. No. 211,778, filed Dec. 1, 1980, and abandoned. In such combination apparatus, a solid-fuel-burning firebox is completely immersed (except for an open firebox end provided with a firebox door) within a liquid heating and thermal storage tank of very large capacity such as 1,000 gallons or more, and with a constantly open venting means at the top of the tank to maintain the tank pressure above the liquid at a level no higher than the ambient atmospheric pressure. The prior device includes a stack for conveying gaseous combustion products from the firebox through the liquid within the tank to an exhaust opening outside the tank, and the prior combination includes blower means connected to the stack for drawing a supply of combustion air into the firebox and forcing the gaseous combustion products out through the stack outlet, after thermal energy has been transferred from the combustion process and its resulting products as effectively as possible to the tank liquid which surrounds the firebox and stack. Such apparatus is designed for the intermittent or successive burning of individual solid fuel loads. Once the burning of such solid fuel loads has brought the tank temperature close to the liquid boiling point at the ambient pressure which is constantly maintained at the top of the tank, the thermal energy of the heated liquid can be stored up to several days and used, as needed, for the heating of room spaces or other building areas, before another solid fuel load needs to be burned.

SUMMARY OF THE INVENTION

The present invention provides improved features primarily intended for use in a combination apparatus and system of the unpressurized type described in my prior application. Some of the features, however, are also suitable for use in pressurized liquid heating tank and boiler systems as further described herein.

Thus the invention provides a flue assembly of improved design for receiving the gaseous combustion products from a firebox immersed within the tank, conveying those combustion products through a circuitous path within the tank liquid, and discharging the gaseous combustion products from the flue assembly into a final exhaust stack having its outlet outside the tank. The flue assembly includes heat transfer enhancing means for increasing the effective heat transfer from the gaseous combustion products in the flue assembly to the liquid in the tank, and such heat transfer enhancing means comprises at least one abrupt-direction-changing, turbulence-generating, heat exchange housing immersed in the tank liquid and having an inlet and outlet serially connected in the flue assembly between the firebox and final exhaust stack. In one preferred aspect of the invention, the housing of a rotary blower is used as such a heat-exchanging housing and is immersed in the tank liquid at a location in the flue assembly just ahead of the flue assembly outlet into the final exhaust stack. The blower fan in such a housing causes an abrupt 90 degree change in direction of the gaseous combustion products, creates the desired turbulence within the blower housing, (via tangetial and radial acceleration of said gaseous combustion products) and thereby enhances the transfer of thermal energy from the gaseous combustion products through the blower housing to the surrounding tank liquid. Moreover, this enhancement of thermal energy transfer is maintained over a long period of time because the turbulent swirl of the combustion gases continuously wipes the blower housing clean. At the same time, the limitation of the maximum tank liquid temperature, which is provided most effectively by the constantly open venting means at the top of the tank of my prior device (and to a lesser degree by liquid in a pressurized tank) also serves to minimize the possibility of higher temperature damage to and excessive wear of the blower parts. Thirdly, a submerged blower housing provides a very effective "scattershield" if the blower fan wheel would ever disintegrate due to particulate loading (or other malfunction). Finally, such an arrangement provides effective operator finger safety and noise reduction.

According to another improved feature of the present apparatus, the flue assembly includes at least one flue member which extends circuitously through the tank liquid and is constructed as an internally-unobstructed, U-shaped tube. Both ends of the tube are generally parallel to each other and oriented so that the base of the U-shape runs generally vertically near the rear wall of the tank, while the ends of the tube extend generally parallel to each other and horizontally through the tank liquid area, with their open ends facing toward the same tank wall portion in which the firebox and firebox door are located. Thus access can be conveniently provided through such wall portion to at least one end of each such U-shaped flue tube for convenience in cleaning or other maintenance. Such a tube also maximizes the possibilities of heat transfer from the flue assembly to the tank liquid.

The improved apparatus of the present invention preferably provides a second heat exchange housing in the flue assembly closer to the end of the assembly which is connected to receive combustion products from the firebox.

The invention also provides special heat transfer limiting (controlling) means in combination with an immersed firebox for minimizing excessive or premature heat transfer from the firebox to the surrounding tank liquid, before there is a full opportunity for efficient and complete combustion at the high temperatures developed by a blower-induced draft of combustion air into the firebox. The preferred limiting means comprises a removable low thermal mass inner liner for the firebox which provides a double-wall construction with an intermediate air space between the burning fuel (and its high combustion temperatures) within the liner and the tank liquid in which the firebox is immersed.

Other features and advantages of the improved present combination will be apparent from the following further description.

BRIEF DESCRIPTION OF THE DRAWINGS

In the drawings which form a part of this application, and in which like reference characters indicate like parts.

DESCRIPTION OF THE PREFERRED EMBODIMENTS

Figure 1:
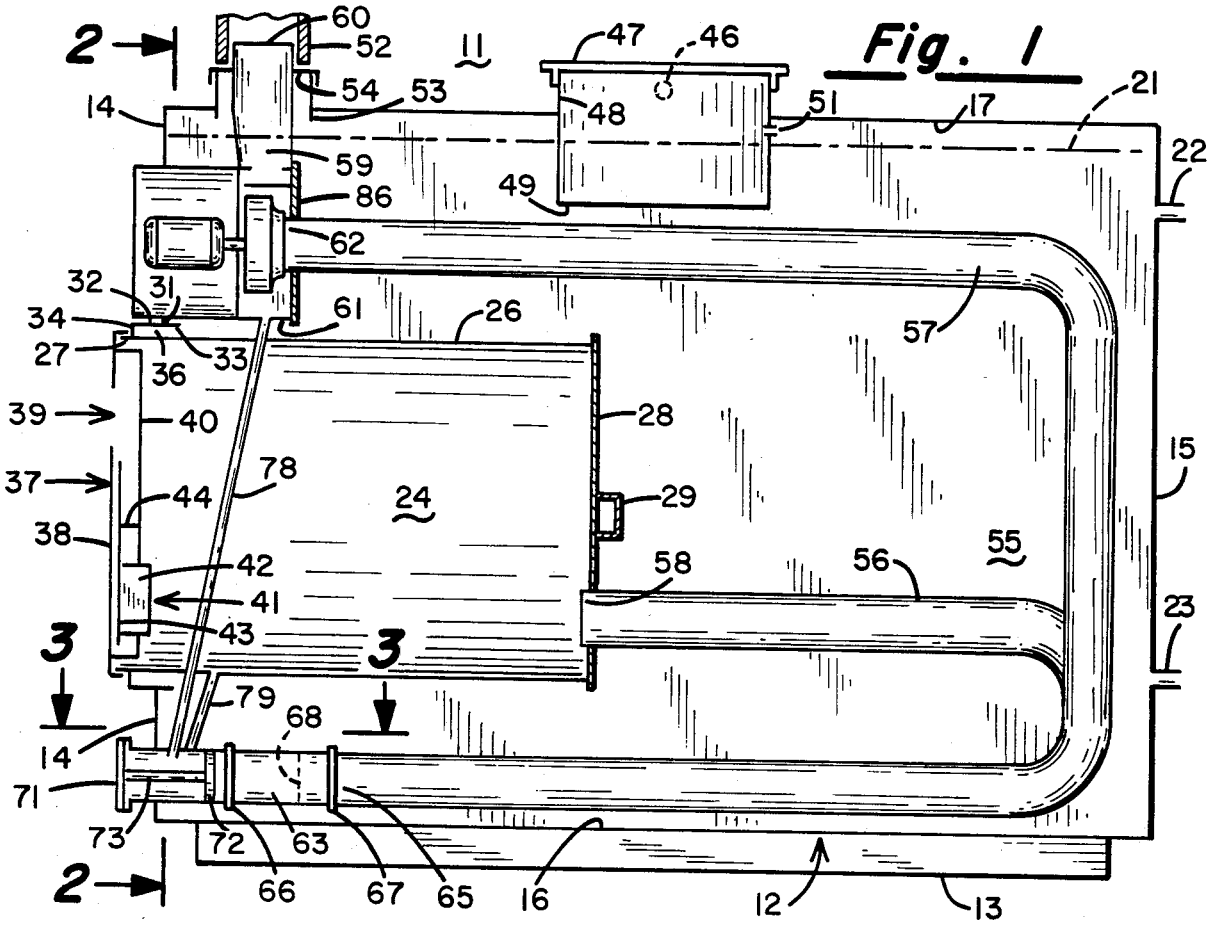
FIG. 1 is a schematic side view with some parts broken away and others shown in section showing one embodiment of the invention with an unpressurized horizontal cylindrical heating and thermal storage tank of the type shown in my prior applications.
Figure 2:
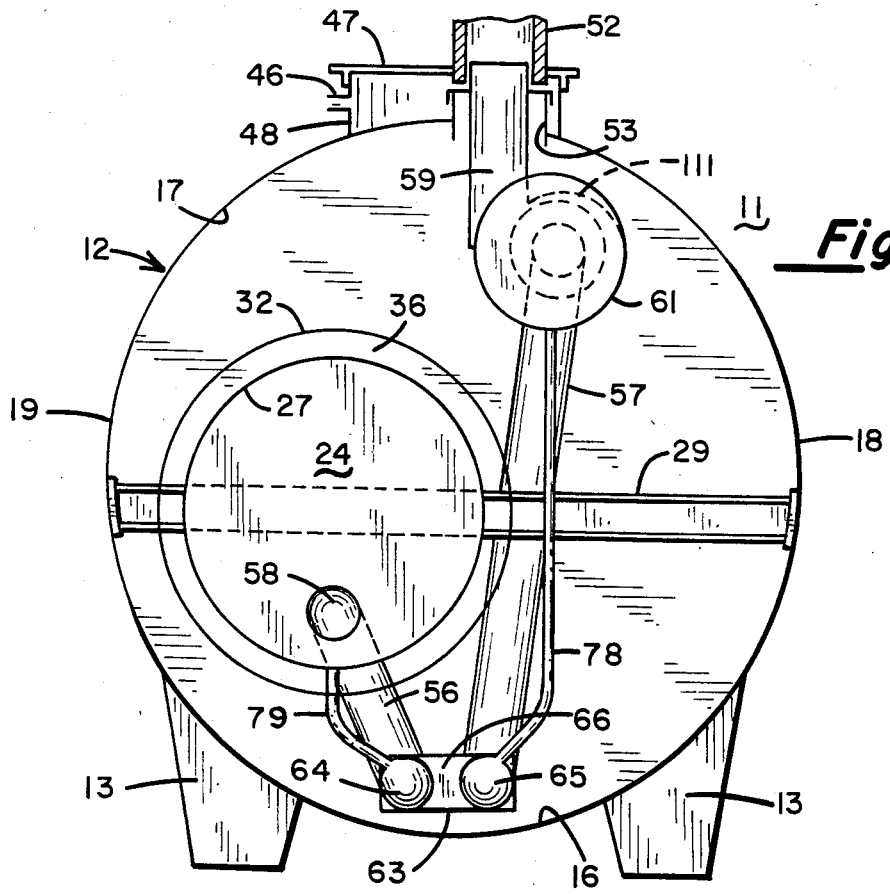
FIG. 2 is a schematic sectional view on the line 2—2 of FIG. 1.
Figure 3:
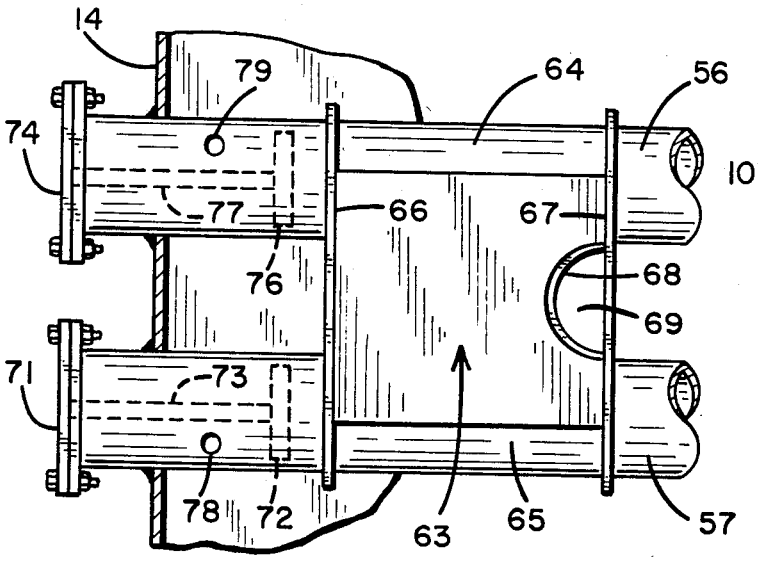
FIG. 3 is a partial sectional view on the line 3—3 of FIG. 1.
Figure 5:
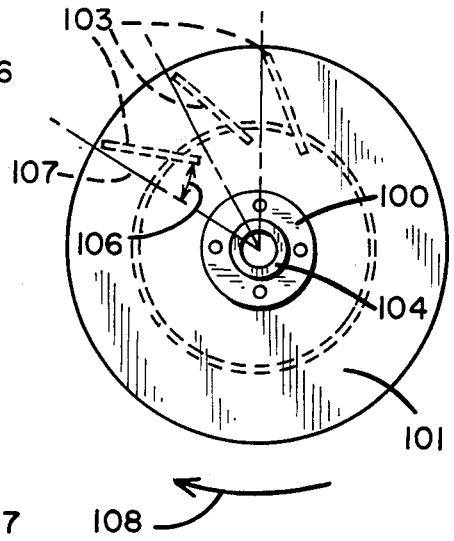
FIG. 5 is an axial view of a preferred form of self-cleaning rotary blower fan as incorporated in the blower of FIG. 4.
Figure 4:
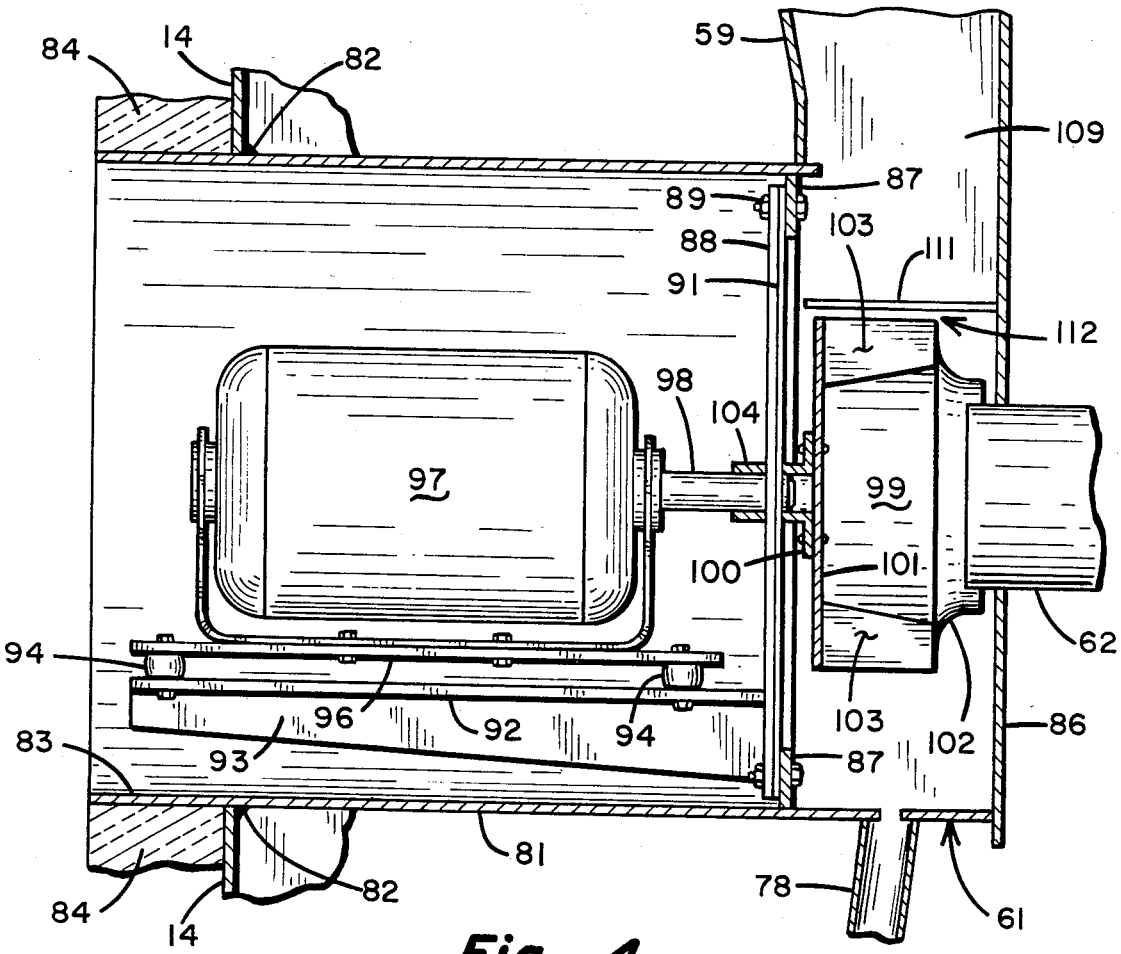
FIG. 4 is an enlarged side view of the blower and blower housing of FIG. 1, with portions broken away and other portions shown in section.

One embodiment of a liquid heating and storage apparatus according to the present invention is shown generally at 11 in FIGS. 1 and 2, with further details shown in FIGS. 3 to 5. The apparatus 11 includes a horizontal cylindrical steel storage tank 12 of substantial capacity, such as more than 1,000 gallons, for containing water to be heated and stored therein. Thus the thermal energy of the heated liquid can be effectively stored and used for its intended heating purposes during intervals up to several days between intermittent burnings of solid fuel in the apparatus.

The tank is supported just above a floor or a ground surface by appropriate longitudinal supporting frames 13 (FIGS. 1 and 2) extending along each side at the bottom of the tank.

Tank 12 has flat, vertical front and rear end walls 14, 15 and the horizontal, cylindrical tank body provides the tank bottom and top wall portions 16, 17 and right and left (as viewed in FIG. 2) side tank wall portions 18 and 19.

Tank 12 is designed to be filled almost to the top, as shown by the liquid level line 21. The tank is further provided with a hot water outlet 22 and a cool water return inlet 23, as shown in rear end wall 15. These provide connections for transfer of thermal energy, as hot water, to a suitable space heating system.

A horizontal, cylindrical firebox 24, suitable for the burning of solid fuel, such as wood logs, is supported within the tank, so that its cylindrical horizontal body portion 26 is fully surrounded by liquid within the tank. The cylindrical axis of the firebox is horizontal and parallel to the cylindrical axis of the surrounding tank itself, but the firebox is offset at one side and slightly below the center of the tank, as is shown in FIG. 2, to provide appropriate clearance for the flue assembly of the present invention.

The firebox body 26 has an outer open end 27 projecting outwardly through a firebox opening 31 in the front tank wall. The firebox also has a closed inner end 28, and is supported at the inner end by a cross bar 29 extending across the interior of tank 12, with its ends welded to the tank side wall portions (FIG. 2).

Between the firebox opening 31 in the front tank wall 14 and the outer open end 27 of the firebox which projects therethrough, the invention provides a special sealing means 32 which forms a liquid-tight water collar having an annular cylindrical section 33 of greater diameter than the external diameter of the firebox and an annular radial section 34 having an inner diameter adapted to fit and be welded to the projecting outer end 27 of the firebox. Thus a water chamber 36, which is in communication with the remaining liquid in the interior of tank 12, surrounds even the projecting outer end of the firebox to insure total immersion of the cylindrical firebox body portion within the tank liquid.

The open outer end 27 of the firebox is then closed by a selectively movable firebox door 37. The door has a double wall construction, with an outer wall 38 in which an air inlet opening 39 is provided for drawing the necessary supply of combustion air into the firebox. The door has an inner wall 40 spaced inwardly from outer wall 38, and wall 40 is provided with a nozzle opening 41 which serves as an air inlet to the firebox itself, after the incoming air has passed through the space between the inner and outer firebox door walls. Both walls extend transversely fully across the firebox open end 27, and openings 39 and 41 are located transversely from each other so the air can move laterally and be preheated by sweeping contact with wall 40. A vertically and axially extending divider plate 42 projects inwardly through the nozzle opening from a vertically and laterally extending half circular radiation shield plate 43, which is supported behind nozzle opening 41 in the space between the front and rear firebox door walls 38 and 40. Details of the door construction are further shown in FIGS. 6 and 7, where the door 132 of the FIG. 6 embodiment has the same construction as door 37 of FIG. 1.

A horizontal baffle 44 above the nozzle opening prevents direct flow of incoming cooler air from the inlet 39 to the nozzle opening 41, prior to reasonable circulation of the air throughout the space between the firebox door walls, thereby cooling the outer door. Thus appropriate preheating of the incoming air supply is facilitated. The radiation shield plate 43 prevents direct radiation from the burning solid fuel in firebox 24 through the nozzle opening 41 against the front or outer door wall 38 of the firebox door 37, and thus maintains the outer wall at lower and safer temperatures with respect to personnel or building structural elements close to the firebox door.

As emphasized in my above earlier patent application, the safety and desired operating characteristics of this type of apparatus are further insured by the provision of constantly open venting means through which the top of the tank is always vented to the ambient atmospheric pressure. Such a venting means is shown as an outlet pipe 46 (e.g., of $1\frac{1}{2}$ inch internal diameter) extending from the external portion of a venting collar 48 which also serves as the support for a removable manhole top or cover 47. This venting collar is welded into a corresponding opening in the top wall portion 17 of the tank and projects downwardly, inside the tank, to a level where its open lower end 49 is below the minimum operating level of the liquid in the tank. The liquid level is generally indicated by the liquid level line 21 in FIG. 1. A small bleed hole (e.g., $\frac{3}{8}''$) is provided in the wall of collar 48 just below the top wall portion 17, so that any pressures higher than ambient external pressure which might arise above the liquid level in those portions of the tank around the venting collar 48 can be vented or equalized within collar 48 and thence to the outside atmosphere through the constantly open venting pipe 46.

The projection of the lower edge 49 of collar 48 to a level below the top of the liquid provides the operating advantage of minimizing any unnecessary loss of water vapor through vent 46 at temperatures close to the boiling point of the liquid at the existing outside ambient pressure, since only a small portion of the total upper surface of liquid within the tank lies within the area of collar 48. The collar and bleed hole arrangement, however, provides full safety in maintaining ambient external pressures in the entire space between the top of the liquid and the top wall portion of the tank, while minimizing the possible loss of liquid as water vapor from top surface areas in the tank outside the collar area.

To provide for ultimate discharge of gaseous combustion products from the firebox within the tank, a final exhaust stack 52 projects upwardly from an exhaust collar 53 welded into the front end of the top wall portion of the tank, as shown in FIG. 1.

The combustion products are carried from firebox 24 to the final exhaust stack 52 by a flue assembly designated generally at 55, which includes one or more U-shaped flue members 56, 57, each of which has the open ends of its U-shaped body facing in the same direction, i.e. parallel to each other and oriented toward the front wall 14 of the tank. The flue assembly includes an inlet 58 connected to the firebox 24, and a flue assembly outlet 59 which delivers gaseous combustion products into the final exhaust stack 52.

The flue assembly of the present invention further includes at least one heat transfer enhancing means, and preferably two such means, each comprising an abrupt-direction-changing, turbulence-generating, heat exchange housing immersed within the tank liquid. Two such housings are shown at 61 and 63 and each one is serially connected within the flue assembly between flue assembly inlet 58 at the firebox and the flue assembly outlet 59.

The preferred form of submerged heat exchange housing is shown at 61 as a rotary blower fan housing, into which the upper open outlet end 62 of the U-shaped flue member 57 delivers gaseous combustion products originating from the firebox. Such combustion products leave the firebox to enter the open upper end or inlet 58 of the U-shaped flue member 56, and are conducted through tube 56 to its lower front end portion 64, which provides an inlet to heat exchange housing 63. From heat exchange housing 63, the gaseous combustion products will be directed back in the reverse direction at the lower front inlet end 65 of U-shaped flue member 57 and thus through a circuitous path along the bottom of the tank, up along the back wall 15 of the tank, and forwardly within the tank liquid to the blower housing 61.

As shown in more detail in FIG. 3, the heat exchange housing 63 is partly defined by the outer cylindrical walls of the flue member ends 64 and 65, in combination with a front vertical cross plate 66 and a rear cross plate 67, each of which fits arounds the respective tube ends 64 and 65 without blocking the interior of either tube, so that such tubes can be accessible through the front wall 14 of the tank for cleaning or other maintenance. The inner halves of tube ends 64 and 65 are cut away so that the addition of tangential top and bottom plates bridging the lateral space between the tube ends and also bridging the axial space between chamber walls 66 and 67 provides a chamber cross section 63 which is essentially rectangular from the top and bottom center lines of each tube end, and is curved outwardly at each side by the outer cylindrical wall portions of the tubes which have not been cut away.

The chamber 63 also includes one vertical half-cylindrical wall section 68, which provides a transitional curved surface around which the combustion products introduced from flue member 56 can flow around and out through tube member 57 to the upper blower housing 61. Curved wall 68 provides a vertical open passage 69 through which the tank liquid can circulate for effective heat exchange from gaseous combustion products flowing along the curved wall 68, while the immersion of the remaining portions of chamber 63 within the tank liquid also promotes the transfer of thermal energy from the combustion products to the surrounding liquid, as such products abruptly change direction in a very turbulent manner within chamber 63.

As shown in FIGS. 1 and 3, the lower front open ends of flue members 56 and 57 project outwardly through front wall 14 of the tank and are provided with removable covers 71 and 74, which are connected to circular cross plates 72 and 76 close to combustion chamber 63 by connecting rods 73 and 77. The plate 72 and 76 do not need to fit tightly within the inner surface of the flue tubes, but essentially close off the front end of the heat exchange chamber in a manner which permits full opening of the respective flue tube ends by removal of covers 71 and 74 with their attached partition plates 72 and 76. In this manner, full access is provided to the interior of both tubes 56 and 57 at their lower ends 64 and 65, so that they can be cleaned readily by suitable cleaning devices which can be pushed through the curved U-shaped ends of the tubes, without disassembling the flue tube members for such cleaning or maintenance. As shown in the apparatus of FIG. 1, it is also possible to insert cleaning devices at the upper ends of each of tubes 56 and 57, for example by insertion through the firebox door and firebox to the upper end 58 of tube 56, and by insertion through the blower housing 61 into the upper end 62 of flue tube 57, when the blower assembly is temporarily removed through the front wall of the tank.

According to a further feature of the invention, means are provided for removal of any liquid condensate which might otherwise collect in the bottom of the firebox or in either of the heat exchange housings 61 and 63. Thus a small diameter condensate drainpipe 78 extends from the bottom of blower fan housing 61 to that portion of tube end 65 between cross plate 72 and cover 71. A further condensate drainpipe 79 of small diameter extends from the bottom of firebox 24 to the other lower tube end 64 at a location between cross plate 76 and its connected removable cover portion 74. The lower horizontal portions of U-shaped flue members 56 and 57 extend slightly downhill from the rear of the tank to the front of the tank, so that any liquid condensate which accumulates within the flue tube members or within the lower heat exchange chamber 63 can flow forwardly past the loosely-fitting cross plates 72 and 76 for collection and ultimate removal at the front of the tank.

FIG. 4 shows details of the blower fan housing and the manner in which the blower elements can be removed for convenient access to the upper open end 62 of flue member 57. The blower fan housing 61 is part of a metallic blower support cylinder 81 which projects inwardly through a circular opening in the front wall 14 of the tank, and is welded to the front tank wall at 82. This cylinder 81 also projects outwardly beyond the front wall as shown at 83 by essentially the same distance as front wall 34 of the water collar portion 32 which extends circumferentially around the outer end 27 of the cylindrical firebox also projects outwardly from front wall 14. Thus, when it is desired to provide a layer of insulation around all or any portions of tank 12, such insulation, shown at 84, can be fitted to the front wall, for example, with a uniform thickness and without blocking access to any of the operating or maintenance areas, such as the blower support cylinder 81, the firebox itself, or the projecting flue tube ends and their covers at 71 and 74.

The rear or inner end of the blower housing cylinder 61 is closed by a rear breeching plate 86 with a circular opening to receive the open upper end 62 of flue member 57. The axial front or outer end of blower fan housing 61 is closed by an axially and outwardly removable blower supporting plate 88, which is secured to the outer side of an annular blower support collar 87 by bolts 89. The inner or blower housing surface of support plate 88 is provided with a thermal insulating layer or separate gasket-like member 91, clamped between collar 87 and plate 88 around the outer periphery of the plate.

A horizontal motor support plate 92 projects outwardly from and perpendicular to plate 88 and is supported in cantilever fashion with the aid of a vertical flange 93 by welding the inner ends of plate 92 and flange 93 to plate 88 and the top edge of flange 93 to the bottom of plate 92. Plate 92, in turn, supports the bottom plate 96 of fan motor 97 by means of intermediate resilient supports 94.

The motor drive shaft 98 is connected to a rotary blower fan 99 within the fan housing portion 61 to rotate the fan member and draw combustion air through the system, by initially drawing such air into the firebox door opening, drawing the gaseous combustion products from the firebox through flue member 56 to the heat exchange chamber 63 and on through flue tube 57 to the blower fan housing 61. The blower fan then creates turbulence by abruptly changing the direction of the incoming gaseous combustion products, sweeping them against the cylindrical inner wall surfaces of the blower fan housing and forcing them upwardly in a path generally tangential to the circumference of the rotary fan to eject such gaseous products through the flue assembly outlet 59 into the final stack member 52.

The rotary fan itself has a circular backing plate 101 secured to the hub flange 100 of a rotary blower hub 104, which projects outwardly through the removable supporting plate 88 and receives the motor shaft 98 by means of a driving connection or spline within the hub.

The rotary blower fan 99 also carries a front inlet ring 102, and a plurality of self-cleaning fan blades 103 are secured between the backing plate 101 and inlet ring 102, so that all these blower fan parts rotate together as a unit around the axis of motor shaft 98.

One preferred radial orientation of fan blades 103 is shown in FIG. 5, where the blades 103 have their inner leading edges inclined by an angle 106 ahead of a radial reference plane 107 (imaginary) passing through the axis of fan hub 104. The direction of rotation is indicated by arrow 108 in FIG. 5, in which the rotary fan is shown as it would be viewed from left to right in FIG. 4.

The blower fan 99 thus receives gaseous combustion products axially from the end 62 of flue tube 57, which projects inwardly with an air and liquid tight connection through breeching plate 86 and slightly within the inlet ring 102 of fan 99. The fan then causes abrupt changes in direction of the gaseous products, throwing them radially and tangentially out against the cylindrical blower fan housing wall 61 and ultimately forcing such gaseous products upwardly through a tangential outlet 109 from the blower housing 61 and into the flue assembly outlet 59 and on through final exhaust stack 52. A curved baffle or guide 111 in blower housing 61 above rotary fan 99 is secured to the breeching plate 86 and projects forwardly to help define the start of the tangential blower outlet 109 and to provide a gradually-increasing transitional air space at the periphery of fan 99, as shown in FIGS. 1 and 4. Partition 111 extends forwardly almost to support plate 88 and its insulation plate or layer 89, and the existence of a slight axial space at the outer end of flange 111 and the radial and tangential projection of gaseous combustion products from the fan blades, can help to draw a small air flow in around the fan hub 104 to avoid outward pressure leakage of combustion products into the blower cylinder portion 81 where the motor 97 is located.

As shown in FIGS. 1 and 4, the motor shaft 98 and the end 62 of flue member 57 are positioned coaxially with respect to each other. Their common axis is offset laterally within fan housing 61, however, as shown in FIG. 2, so that the blower fan housing outlet 109 may extend upwardly in a tangential manner with respect to one side of the cylindrical blower housing.

Figure 6:
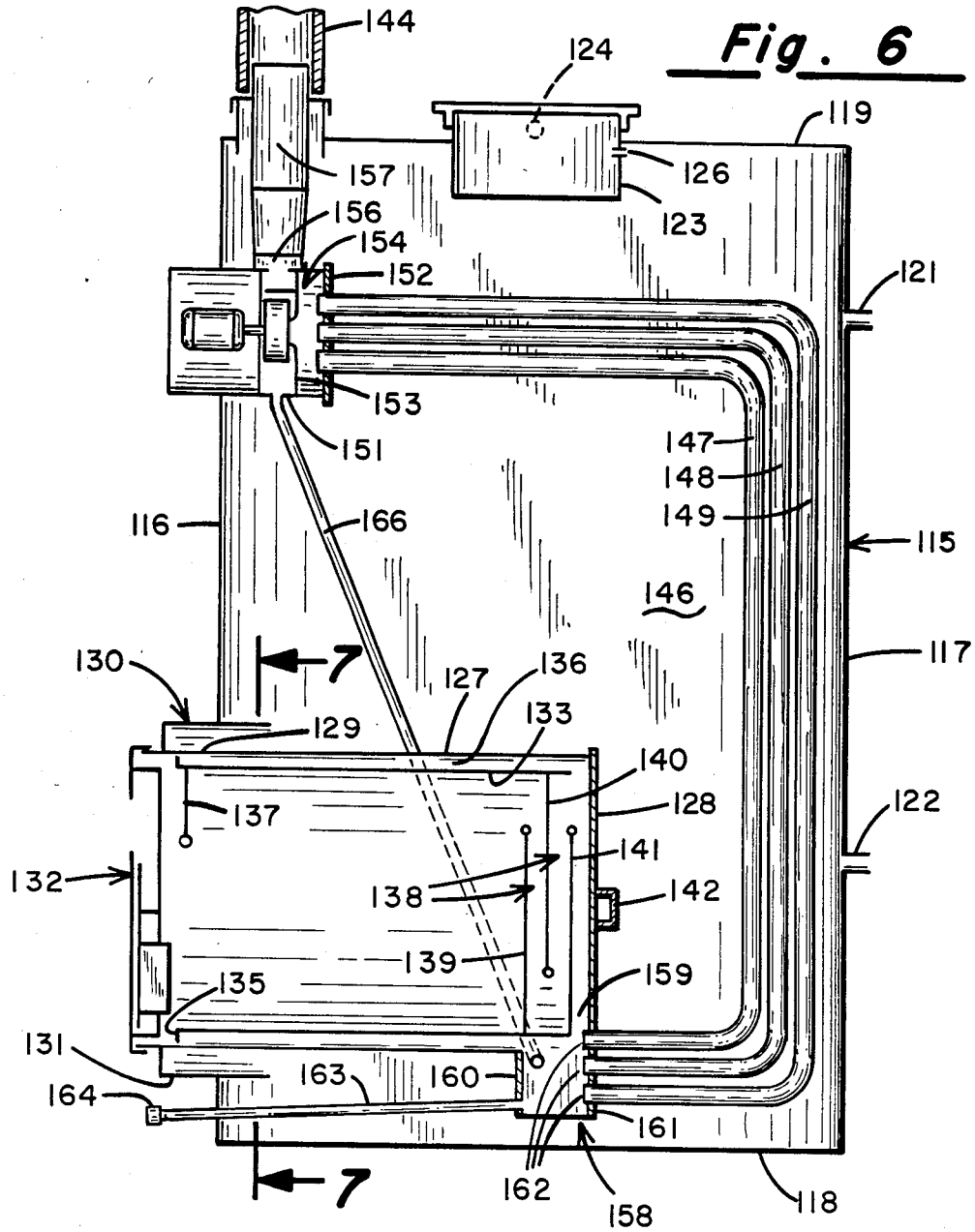
FIG. 6 is a schematic side view, similar to FIG. 1, of another embodiment of the invention which has an unpressurized vertical cylindrical heating and storage tank.

In the embodiment of the invention shown in FIG. 6, the large capacity combination heating and storage tank 115 is a cylindrical steel tank with its cylindrical axis vertical. The cylindrical body portion accordingly provides a curved front wall portion 116, a curved rear wall portion 117, as well as flat bottom and top wall portions 118 and 119. A hot water outlet 121 and a cold water return or inlet 122 are provided in the wall portion 117. Tank 115 includes a venting and manhole collar 123, similar to the corresponding portions of FIG. 1. A constantly-open vent 124 maintains the space above the liquid and just below top wall 119 at ambient pressure. Bleed hole 126 helps to equalize the pressure across the entire top of the tank, while collar 123 limits the loss of water vapor from the upper surface of the liquid, in the same manner described in connection with the FIG. 1 embodiment.

The firebox 127, like the firebox of FIG. 1, is a horizontal steel cylinder, which is provided with a vertical rear end wall 128 and an open front end 129 projecting outwardly through the front wall portion 116. In this case, in view of the curved or cylindrical nature of the front wall portion 116, the horizontal cylindrical axis of firebox 127 is located in the center of the tank, and the blower fan housing described below is centered directly above the firebox, without the relative lateral offset arrangement shown in FIG. 2. The firebox of FIG. 6 has the same sealing arrangement with the front wall portion, by means of a water jacket and sealing collar 130 similar to the corresponding collar in FIG. 1. In this case, however, the front portion of the collar must remain in a common plane as in FIG. 1, but the cylindrical connecting portion 131 of the water sealing collar must be of gradually increasing axial length to accommodate the fact that longer portions of the firebox extend beyond the front wall at the lateral sides of the firebox than at the vertical center line thereof.

Figure 7:
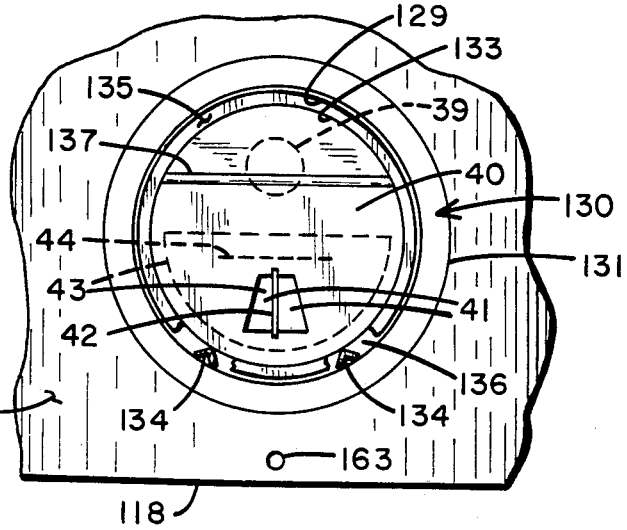
FIG. 7 is a partial sectional view on the line 7—7 of FIG. 6 showing details of the firebox door, firebox and liner in the apparatus of FIG. 6.

The firebox door 132 in the embodiment of FIG. 6 is essentially identical to the door 37 of FIG. 1, and the location and shape of the air inlet opening 39, nozzle opening 41, divider plate 42, vertical radiation shield 43 and horizontal baffle 44 are further shown in FIG. 7.

In FIGS. 6 and 7, the firebox is shown with special means for limiting the heat transfer from the primary combustion area or chamber within the firebox through the firebox cylindrical wall to the surrounding liquid in the tank. The specific heat transfer limiting means is illustrated as a cylindrical steel liner 133 supported coaxially within the cylindrical steel firebox by means of axially extending angle irons 134 welded along the bottom inside surface of firebox body 127. Thus the liner cylinder 133 may be selectively inserted and removed from the firebox through the open outer end of the firebox, when the firebox door is open.

Additionally, the liner may be fastened to the firebox, but only at one end, thus allowing unencumbered longitudinal expansion upon heating.

The cylindrical steel liner 133 may be constructed of other heat resistant materials (i.e. materials such as stainless steel, thin castable ceramics or coatings, etc., which resist degradation under conditions of high temperature and excess oxygen). The liner material is to be of low thermal mass to facilitate its rapid heating during the beginning stages of a burn. This low mass reduces the quantity of pollutants given off as the combustion chamber is initially heated, thus allowing a normal combustion temperature range of 1600 degrees to 2000 degrees F. A low mass liner allows these temperatures to be reached within a couple of minutes with normal fuels, whereas higher mass materials such as fire brick would take 15 to 25 minutes before allowing such temperatures during the combustion process.

The outer end of the liner is also provided with an annular, outwardly-projecting radial flange 135 which has an outer diameter only slightly less than the inside diameter of the firebox body 127. The flange 135 in FIG. 7 extends around the entire circumference of firebox end 129 and is actually beyond or behind the angle iron supports 134 in that figure. Parts of the flange 135 are broken away in FIG. 7, however, merely to show the structure of supports 134 more clearly without the possible confusion of the complete showing of annular flange 135 in the background.

Flange diameter 135 is sized to allow a controlled flow of air from the door through the space between the flange 135 and the firebox projection 129. This air flow continues through air space 136 which is accordingly provided between the outside of the liner and the inside of the firebox. This air space, and the air flow through it, controls the temperature of the liner walls. The liner wall temperature is hot enough to allow high temperature combustion without quenching. At the same time the slight air flow between the liner and the firebox cools the liner enough to prevent structural and/or metallurgical failure. The heat which is removed from the liner is then carried to the heat transfer enhancing housing 158 and through to the flue assembly 146. If the liner is constructed out of a more heat resistant material, or coated (i.e. ceramics, etc.) for longer life in a high temperature environment, the space between the flange 135 and the firebox could be substantially closer to prevent any air flow between the liner and the firebox walls. The air space alone would serve to control the heat transferred to the water in contact with the firebox walls (i.e. remove enough heat from the liner to prevent failure, while allowing high temperature combustion). In either case, the space allows unrestrained radial expansion upon heating and prevents creosote and/or particulate deposition upon either the liner walls or firebox walls. The liner can delay the transfer of some of the thermal energy from the gaseous combustion products until they pass through the flue assembly, with its flue members extending in a circuitous path and with its heat transfer enhancing heat exchange housing or housings connected to withdraw as much heat as possible from the gaseous combustion products, before they are ejected through the final exhaust stack at temperatures hopefully not exceeding 250 degrees to 375 degrees Fahrenheit.

As shown in FIGS. 6 and 7, the firebox liner 133 is provided with a transverse top shield 137 across the upper portion of its open end. Shield 137 is designed to prevent accidental overloading of the firebox by an operator and also to help direct the initial combustion air supply partly at the stack of burning wood.

The firebox liner of FIG. 6 is also provided at its rear or inner end with baffles defining a secondary reaction chamber 138. Such a reaction chamber is desirable in providing an opportunity for further interaction between some of the preheated incoming fresh air supply and the initial products of combustion which contain substantial quantities of carbon monoxide gas (CO). Additional oxygen from the excess preheated incoming air supply can react with the carbon monoxide to yield carbon dioxide ($CO_2$). Such a reaction is exothermic, and can increase the exit temperature of the gaseous combustion products by about 10 degrees to 200 degrees F. in such a reaction chamber area. Such a reaction is enhanced by turbulence, high combustion temperatures and a gaseous path length long enough to allow the reaction to occur.

In this case the reaction chamber is defined by three vertical baffle members 139, 140 and 141, which are generally parallel to each other and spaced from each other and from the rear firebox wall 128. Baffle 139 extends upwardly from the bottom of the liner and leaves an air passage across the top of the baffle. Baffle 140 extends downwardly from the upper wall portion of the liner and thus directs the gaseous combustion products downwardly between baffles 139 and 140. Baffle 141, located between baffle 140 and firebox end wall 128, extends upwardly from the bottom rear end of the liner and thus directs the hot gaseous products back up between baffles 140 and 141 and then ultimately downwardly again between baffle 141 and rear firebox wall 128. Supporting cross bar 142 is connected to the firebox end wall 128 and is welded at its ends to the curved side wall portions of tank 115 to help support the weight of the firebox and liner assembly.

In FIG. 6, the final exhaust stack 144 is constructed and supported in the same manner as the corresponding stack of FIG. 1, and a flue assembly 146 is provided to receive hot gaseous combustion products from the firebox and deliver them by a circuitous path and with the help of at least one and preferably two heat transfer enhancing housings for final discharge through stack 144. The flue assembly 146 of FIG. 6 includes a plurality of U-shaped flue tubes, three of which are shown at 147, 148, and 149. The number of such tubes may be varied depending on the tank dimensions and the relative distances available for the horizontal lower and upper "runs" of the U tube members, as well as the length of the vertical run at the base of such U shapes. For example, the number of tubes could vary from one to twelve, depending partly upon the factors just discussed and upon the desired diameter of the tubes and the number needed for efficient transfer of as much thermal energy as possible from the gaseous combustion products before they are ejected at stack 144.

In FIG. 6, a blower housing 151 is again used as a submerged heat exchange housing, which has a breeching plate 152 to receive the open front upper ends of each of the U-shaped tubes of the flue assembly. In this case, the breeching plate 152 is spaced axially away from the blower fan, and an inlet partition 153 is positioned close to the fan to help define a collection or distribution chamber 154, in which the gaseous combustion products from the different flue tubes can mix together and go through a single axial inlet into the blower fan itself. The tangential blower outlet 156 is connected to the flue assembly outlet 157 which discharges the combustion products into stack 144.

FIG. 6 also shows another heat-transfer-enhancing housing 158 just below the inner end of the firebox. Housing 158 has an inlet 159 to receive the gaseous combustion products from the secondary reaction chamber 138. Chamber 158 has a front wall portion 160 and a rear wall portion 161. The rear wall has chamber outlet openings 162 oriented 90 degrees from the inlet 159, to help insure turbulence within housing 158 in response to the abrupt direction changes of the gaseous combustion products. A condensation drain pipe 163 of small diameter extends from the forward bottom portion of chamber 158 through the front tank wall portion 116 and is closed by a removable cap 164 for drainage when desired. A condensation drain 166 is also provided to connect the bottom of the blower fan housing 151 to the chamber 158, where any condensate can then also be carried forwardly through the condensation drain 163 which slopes downwardly from the chamber 158 to the front wall of the tank. Any condensation products within the firebox body 127 can also drain into the chamber 158 for ultimate removal at 164.

Figure 8:
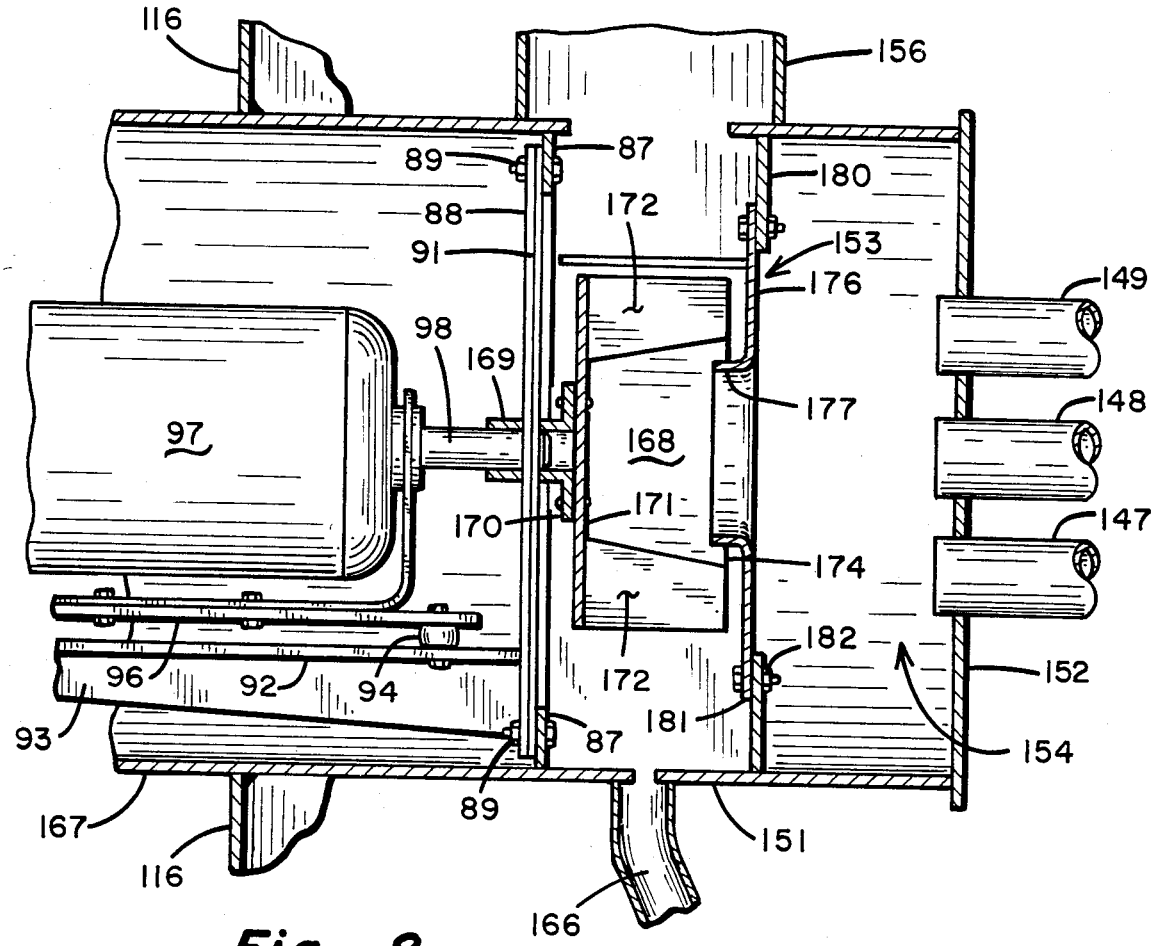
FIG. 8 is an enlarged side view, similar to FIG. 4, of the blower housing and mechanism of FIG. 6.

FIG. 8 shows details of the blower housing and blower of this embodiment of the invention. Here the cylindrical blower fan housing 151 has a portion 167 extending out through the front wall portion 116 in a manner similar to that shown in FIG. 3. The details of the supporting collar 87 and motor 97 and motor support plates and mountings are essentially identical to those in FIG. 3 and are shown by similar reference numbers.

In FIG. 8, the motor shaft 98 extends in driving connection into the hub 169 of blower fan 168. The fan hub flange 170 is secured to the backing plate 171 of the blower fan, and the blades 172 of the fan extend radially from the fan axis and are secured between the fan backing plate 171 and the front inlet plate 174 of the fan itself.

Figure 9:
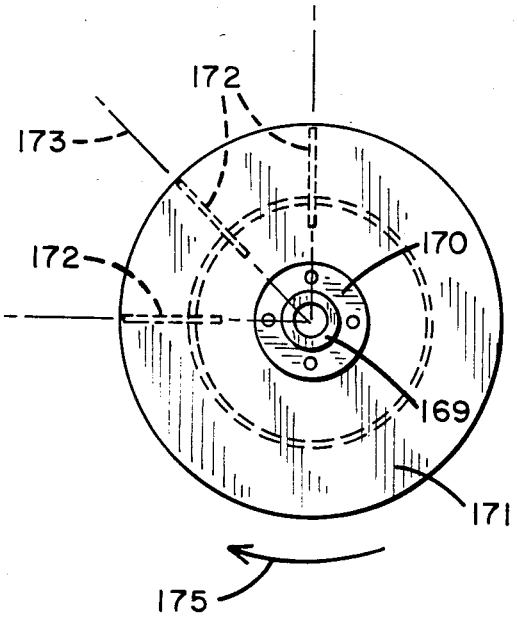
FIG. 9 is an axial view, similar to FIG. 5, of another form of self-cleaning rotary fan, for use in the blower mechanism of FIGS. 3 and/or 6.

As shown in FIG. 9, the fan blades 172, as viewed from left to right in FIG. 8 extend directly along radial planes defined in part by the axis of the fan member, as shown by the radial line 173. Arrow 175 in FIG. 9 shows the direction of rotation, and it is clear that both the inner and outer edges of each fan blade 172 lie in the same common radial plane for that blade. FIGS. 9 and 5 show the range of fan blade angles which are preferred for use in the present invention in order to achieve self-cleaning operation of such rotary fans. In other words, the radial fan blade arrangement of FIG. 9 can be used in the blowers of either FIG. 1 or FIG. 6, while the blower fan blade inclination of FIG. 5 can also be used in either embodiment. Thus a range of blade angles from the radial plane (FIG. 9) to a rearwardly and outwardly inclined plane (FIG. 5) can be used satisfactorily, but fan blades should not be used which extend outwardly and forwardly (with reference to the direction of rotation) as compared to a radial plane containing the fan axis.

As shown in detail in FIG. 8, the inlet partition indicated generally at 153 in FIG. 6, is preferably formed in two annular sections, to provide access to the front ends of flue tubes 147, 148 and 149, when the blower assembly is selectively removed from its cylindrical housing 151, 167. Thus the annular central portion 176 of the partition has an outer diameter at 181 less than the inner diameter of the supporting flange 87 for the blower support plate 88. This annular partition 176 has a delivery opening lip 177, which projects axially into the front inlet plate opening of the blower fan.

Circular partition plate 176 is removably secured to a radially inwardly projecting annular support flange 180 by bolts 182. The relative location of plate 176 on the outwardly facing surface of support flange 180, and the limited diameter of the outer edge 181 of partition plate 176, thus make it possible to disconnect and withdraw plate 176 through the circular and larger central opening in blower support flange 87, after the blower support plate 88 and associated motor and fan parts have been withdrawn. Full access is thus provided from the front of the tank to the open upper ends of the U-shaped flue tubes 147, 148 and 149 for cleaning or maintenance. Similar access can be obtained to the lower ends of such tubes by selective removal of the firebox liner axially out through the open end of the firebox. The outwardly facing open ends of the flue tubes can then be reached through the firebox opening and heat exchange chamber 158 for desired cleaning and maintenance of these lower ends of the flue tube members.

A number of the features described in connection with one of the embodiments of FIGS. 1 and 6 can also be utilized in connection with an embodiment having the alternate tank orientation of the other embodiment. For example, the firebox liner of FIGS. 6 and 7 can be used, and in many cases should preferably be used, in the firebox arrangement shown in the embodiment of FIG. 1, to minimize undesired premature heat transfer from the firebox which might reduce the efficiency of combustion. The blower fan blade arrangements of FIGS. 5 and 9 are interchangeable, as described. The selectively removable inner partition 176 of FIG. 8 could conceivably be omitted, if a blower fan is used with a sufficiently wide opening in its front inlet plate 174 so that the delivery lip opening 177 of a fixed partition would have sufficient diameter to provide adequate access to all of the flue tube ends which might be open to the inner distribution chamber.

Figure 10:
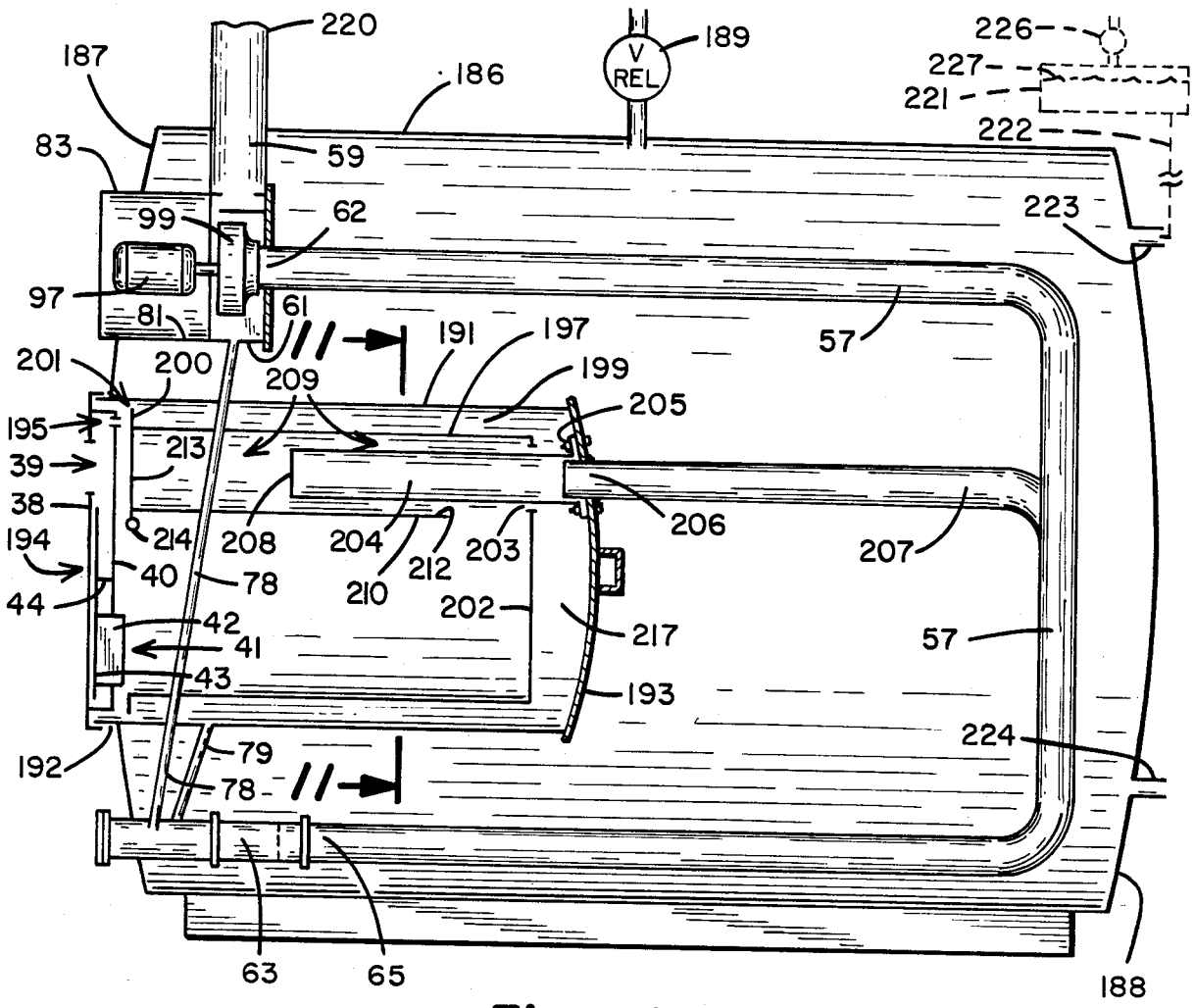
FIG. 10 is a view similar to FIG. 1 showing certain features of the present invention in a horizontal cylindrical heating tank or boiler for a pressurized system.
Figure 11:
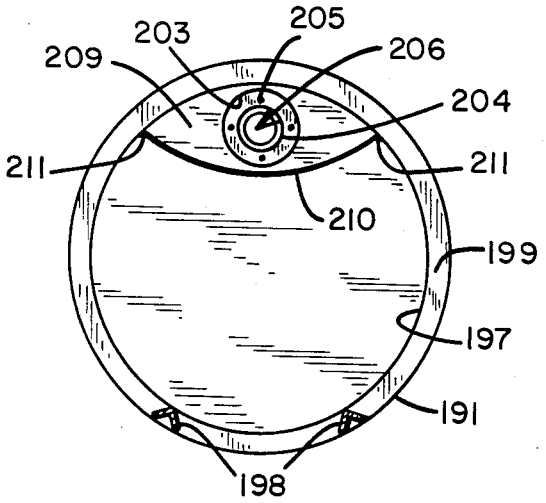
FIG. 11 is a partial sectional view on the line 11—11 of FIG. 10.

FIGS. 10 and 11 show another embodiment of the invention in which a submerged blower fan housing and an immersed firebox with a removable low mass liner and secondary reaction chamber can be used advantageously in a pressurized heating system. A cylindrical horizontal tank or boiler member 186 is provided with front and rear end walls 187 and 188, which may be outwardly convex, and with an adjustable pressure relief valve 189 for establishing a desired pressure, e.g., up to 30 p.s.i.g. (pounds per square inch gage) for the room or space heating system to which tank 186 is to be connected.

A horizontal cylindrical firebox 191 is positioned within the tank at a level for substantially complete immersion, except for the outer open end 192. A convex inner end wall 193 provides a liquid-tight and pressure resistant inner end for the firebox 191. The outer end 192 is closed by a firebox door of essentially the same construction as doors 37 and 132 described in connection with FIGS. 1, 6 and 7. In the construction of FIG. 10, however, the door 194 may be and preferably is provided with one or more small secondary air feeding holes 195 for feeding some of the air into the annular air space 199 between the cylindrical firebox 191 and the coaxial cylindrical liner member 197. The liner is supported on longitudinal angle irons 198 for selective axial removal of the liner through the outer end 192 of the firebox, when desired for cleaning or maintenance. The outer or front end of liner 197 has a radially projecting end flange 200 at the front of the firebox to partially close the front or inlet end of the air space 199. By making the outer diameter of flange 200 smaller than the internal diameter of the liner end 192 by a predetermined specific dimension, a controllable annular secondary air inlet space is provided at 201 to obtain a desired limited flow of secondary air through the space 199 to the rear end of the firebox.

Cylindrical liner 197 has a rear end wall 202 which completely closes the rear of the combustion chamber within the liner, except for an opening 203 near the top of the liner. A flue tube extension 204 has a flange which is removably secured by removable nuts 105 to bolts fixed to the rear firebox wall 193. Tube 204 extends forwardly toward the firebox end 192 in coaxial alignment with the inlet end 206 of a U-shaped flue assembly member 207 which has a pressure-tight connection with the rear firebox wall 193. The internal diameter of opening 203 in the liner rear wall 202 is greater than the external diameter of the flue tube inlet extension 204. The annular space between the edges of opening 203 and the outer surface of tube 204 provide an inlet area through which the preheated secondary air passing rearwardly through space 199 can reverse itself and be drawn forwardly into the secondary reaction chamber 209 at the top of the firebox liner 197. This secondary reaction chamber is partly defined by a curved bottom wall 210 which has its longitudinal edges welded or otherwise secured at 211 to the top liner wall portion, so that the firebox has a cross section as generally shown in FIG. 11. The rear end of this secondary reaction chamber is open at 212, so that it can receive both the secondary air which is drawn through the opening 203 and the gaseous combustion products from the burning of solid fuel in the lower portion of the liner below the partition 210.

The forward end of the secondary reaction chamber is closed by a vertical partition wall 213 which has a transverse lower edge 214 and is similar in construction to the partition 137 of FIGS. 6 and 7. The flue tube member 207 is generally similar to the U-shaped flue tube 56 of FIGS. 1–3, except that its inlet end 206 is connected to the upper portion of the rear firebox wall 193. Thus the lower open end of this U-shaped flue tube 207 carries the gaseous combustion products from the firebox to a heat exchange housing 63, in which the moving gaseous products are abruptly reversed with great turbulence and drawn into the lower end 65 of U-shaped flue tube 57. The upper end 62 of tube 57 is then connected to deliver the gaseous products axially into a similar blower fan housing 61, where the rotary fan 99 causes another abrupt direction change to a tangential outlet 59 discharging the materials from the flue assembly into a final outer exhaust stack 220. Details of the blower support housing 81 and its front extension 83 and of the motor 97 and its mounting are essentially identical to those shown in the embodiment of FIGS. 1–5 or FIGS. 6, 8 and 9, as indicated by the similar reference numbers in FIG. 10.

During operation of the embodiment of FIGS. 10 and 11, the rotary fan 99 in the submerged blower fan housing 61 will draw or induce a draft of combustion air inwardly through the firebox door opening 39, through both the combustion chamber within liner 197 and the insulating air passages 199 and 217 between the inner liner walls and the outer firebox walls. The induced draft and the arrangement of the secondary reaction chamber 209 will provide an opportunity for conversion of CO gas to $CO_2$, and the gaseous combustion products will then be drawn through flue member 207, heat exchange chamber 63, and end flue member 57 to the blower fan housing 61 for ultimate discharge through stack 220.

It will be understood that the specific firebox liner shown in FIGS. 10 and 11 and the circulation of secondary air from the firebox door through the space between the liner walls and firebox walls can be used in the embodiments of FIGS. 1–5 and 6–9, and that the relative advantages of either or both of the submerged blower features and the firebox liner features can be used to advantage in both the unpressurized liquid heating and storage tanks of the first two embodiments and the pressurized boiler or tank of FIGS. 10 and 11. As shown in dotted outline in FIG. 10, when this embodiment is used with an adjustable pressure relief valve 189 and is connected to a room or space heating system by the hot water outlet 223, it is customary to provide an expansion tank shown in dotted outline at 221 near the top of the heating system which would be connected at 222 to the hot water outlet 223. A return inlet 224 brings cooler water back from the room or space heating system to the tank 186. The expansion tank has a pressure relief valve 226, and the liquid level 227 is normally below the top of the expansion tank.

The features described herein accordingly provide an improved liquid heating and storage apparatus of the type in which a solid-fuel-burning firebox is essentially fully immersed within a tank of adequate capacity to store the desired quantity of liquid to be heated, and in which the top of such a tank is constantly vented to ambient atmospheric pressure and the efficiency of combustion is enhanced by blower means connected to draw a full supply of combustion air into the firebox, draw the resulting gaseous combustion products from the firebox and through a suitable flue assembly and force such combustion products out through a final exhaust stack. The features described herein provide for greater efficiency of combustion, more efficient transfer of the thermal energy originally present in the wood fuel to the liquid to be heated, and greater safety, operating convenience, and longer life or minimal maintenance of parts.

The foregoing specification sets forth certain preferred embodiments and modifications of the invention. Changes in the described embodiments, as well as alternate arrangements for carrying out the described invention, may also be apparent to those skilled in the art, within the spirit and scope of the following claims:

I claim:

1. A combination solid-fuel burning liquid heating and thermal energy storage apparatus for storing heated liquid at temperatures suitable for the heating of room spaces and other uses during intervals of up to several days between intermittent burnings of successive fuel loads, said apparatus comprising a storage tank of substantial capacity having top, bottom, front, back, and side tank wall portions for containing a large volume of liquid, such as more than 1,000 gallons, to be heated and stored therein, the front wall portion having a single firebox opening therein spaced above the bottom tank wall portion, a liquid-tight firebox fixed within said tank and having an open outer fuel-loading end accessible through the firebox opening, means providing liquid-tight engagement between the outer firebox end and the tank wall portion around the firebox opening, a firebox door member for selectively opening and closing said firebox open end, said firebox also having a main body portion within the tank including top, bottom, and side firebox wall portions and an inner firebox end wall portion opposite the outer firebox end, means supporting the firebox at a level above the bottom tank wall portion within the tank for substantially complete immersion of said firebox top, bottom, side and inner end wall portions within the tank liquid, means constantly venting the top of said storage tank to ambient pressure outside the tank and thereby holding the maximum tank liquid temperature close to the liquid boiling point at such ambient pressure and preventing increases of the internal tank pressure and external tank temperatures above safe levels with respect to any immediately adjacent building walls, an exhaust stack member extending outwardly from the inside to the outside of the tank, a flue assembly within the tank comprising at least one flue member extending circuitously through the tank liquid, the flue assembly having a flue inlet connected to receive gaseous combustion products from the firebox, a flue outlet connected to the exhaust stack, and heat transfer enhancing means for increasing the effective heat transfer from gaseous combustion products in the flue assembly to the liquid in such tank, said heat transfer enhancing means comprising at least one abrupt direction-changing, turbulence-generating heat exchange housing immersed in the tank liquid and having an inlet and an outlet serially connected in the flue assembly between the firebox and final exhaust stack, and blower means connected to at least one of said exhaust stack and flue assembly members for drawing a supply of combustion air into the firebox outer end and firebox, drawing the gaseous combustion products out of the firebox into the flue assembly and providing a forced discharge of such combustion products out of the exhaust stack during the burning of each successive fuel load, in which said one immersed turbulence-generating, heat exchange housing comprises a rotary blower fan housing for said blower means having an axial inlet and a tangential outlet, and in which said blower means includes a rotary fan in said rotary blower fan housing and motor means outside the tank connected through a tank wall portion for driving said rotary fan, thereby enhancing the transfer of thermal energy from the gaseous combustion products through the blower fan housing to the liquid in the tank and minimizing possible high temperature damage to the blower means, noise, and danger to nearby personnel.

2. Apparatus according to claim 1 in which said one flue member consists of an internally-unobstructed U-shaped tube with generally parallel open tube ends extending from a smoothly curved intermediate U-shaped base portion, one open end of such tube being axially oriented toward the same wall portion of the tank having the firebox opening, said front wall portion having means for selective access to at least one of the axially oriented ends of such tube for convenient cleaning thereof without substantial disassembly of the flue member from the flue assembly and tank.

3. Apparatus according to claim 1 in which said flue assembly includes one flue tube member having an inlet end connected to receive combustion products from the firebox and an outlet end extending within the tank liquid toward one wall of the tank and a second flue tube member having an inlet end extending within the tank liquid toward the same wall of the tank parallel to and close to the outlet end of said one flue tube member, and in which another immersed turbulence-generating, heat exchange housing extends transversely from said one flue tube member outlet end to said second flue tube member inlet end at a location within the liquid spaced inwardly from the tank wall, thereby providing an abrupt direction-reversing chamber for the gaseous combustion products entering the heat exchange housing from said one flue tube member outlet end and leaving said housing in a reverse parallel direction through said second flue tube member inlet end.

4. Apparatus according to claim 3 in which said one flue tube member outlet end and said second flue tube member inlet end extend axially beyond said immersed heat-exchange housing to said one wall of the tank and said one wall has means for selective access to the respective first and second flue tube outlet and inlet ends for convenient cleaning of said flue tube members without substantial disassembly of such members from the flue assembly and tank.

5. Apparatus according to claim 1 in which the firebox includes a low mass heat transfer limiting means for minimizing excessive heat transfer from the combustion temperatures within the firebox to the surrounding liquid in the tank while said blower means maintains the high firebox temperatures required for efficient solid fuel combustion, with minimal production of pollutants.

6. Apparatus according to claim 5 in which the firebox heat transfer limiting means comprises an inner liner having inner wall portions spaced inwardly from the firebox top, bottom, and side walls, in which the inner wall portions provide a low-mass solid-fuel-containing inner combustion chamber, and the firebox wall portions provide a liquid-tight, outwardly-spaced, liquid-engaging outer firebox container surface for immersion in the tank liquid with a heat-transfer-limiting air space between said inner combustion chamber and said outer firebox container surface.

7. Apparatus according to claim 6 in which the firebox is cylindrical and the inner combustion chamber comprises a cylindrical liner which is removably supported within the firebox for selective removal and insertion through the open outer firebox end when the firebox door is open.

8. A combination solid-fuel-burning, liquid heating and thermal energy storage apparatus according to claim 1 in which the means providing liquid tight engagement between the outer firebox end and the tank wall portion around the firebox opening comprises an annular water chamber collar having a cylindrical wall portion of greater diameter than the firebox end and projecting concentrically and axially around the outer firebox end, and said collar also having an annular circular radial wall portion extending inwardly from the cylindrical wall portion to the outer firebox end, said collar wall portions thereby providing an annular water chamber communicating with the tank liquid and extending from the tank wall portion axially outwardly all around the projecting firebox outer open end.

9. A combination solid-fuel burning liquid heating and thermal energy storage apparatus for storing heated liquid at temperatures suitable for the heating of room spaces and other uses during intervals of up to several days between intermittent burnings of successive fuel loads, said apparatus comprising a storage tank of substantial capacity having top, bottom, front, back, and side tank wall portions for containing a large volume of liquid, such as more than 1,000 gallons, to be heated and stored therein, the front wall portion having a single firebox opening therein spaced above the bottom tank wall portion, a liquid-tight firebox fixed within said tank and having an open outer fuel-loading end accessible through the firebox opening, means providing liquid-tight engagement between the outer firebox end and the tank wall portion around the firebox opening, a firebox door member for selectively opening and closing said firebox open end, said firebox also having a main body portion within the tank including top, bottom, and side firebox wall portions anad an inner firebox end wall portion opposite the outer firebox end, means supporting the firebox at a level above the bottom tank wall portion within the tank for substantially complete immersion of said firebox top, bottom, side and inner end wall portions within the tank liquid, means constantly venting the top of said storage tank to ambient pressure outside the tank and thereby holding the maximum tank liquid temperature close to the liquid boiling point at such ambient pressure and preventing increases of the internal tank presure and external tank temperatures above safe levels with respect to any immediately adjacent building walls, an exhaust stack member extending outwardly from the inside to the outside of the tank, a flue assembly within the tank comprising at least one flue member extending circuitously through the tank liquid, the flue assembly having a flue inlet connected to receive gaseous combustion products from the firebox, a flue outlet connected to the exhaust stack, and heat transfer enhancing means for increasing the effective heat transfer from gaseous combustion products in the flue assembly to the liquid in such tank, said heat transfer enhancing means comprising at least one abrupt direction-changing, turbulence-generating heat exchange housing immersed in the tank liquid and having an inlet and an outlet serially connected in the flue assembly between the firebox and final exhaust stack, and blower means connected to at least one of said exhaust stack and flue assembly members for drawing a supply of combustion air into the firebox outer end and firebox, drawing the gaseous combustion products out of the firebox into the flue assembly and providing a forced discharge of such combustion products out of the exhaust stack during the burning of each successive fuel load, in which the means constantly venting the top of the tank to ambient pressure comprises a cylindrical venting collar extending through the top wall of the tank and having an open lower end projecting below the minimum liquid level within the tank, said venting collar having a constantly open vent opening of substantial cross-sectional area at a level above the top of the tank and a constantly open lateral bleed opening of limited cross-sectional area at a level just inside the top of the tank and above the tank liquid level, said venting collar construction maintaining ambient outside pressures within the entire top of the tank while minimizing the loss of water vapor from the upper surface of the tank liquid outside the area of the venting collar.

10. In a fuel-burning liquid heating apparatus having a tank for heated liquid, a firebox associated with said tank and providing a combustion chamber for burning fuel to heat such liquid, an exhaust stack extending outwardly from the inside to the outside of the tank, a flue assembly extending from the combustion chamber through the liquid in the tank to the exhaust stack, and a blower means for drawing gaseous combustion products from the combustion chamber to the exhaust stack, the improvement in which said blower means comprises a blower fan housing with a rotary blower fan therein, the blower fan housing being supported within the tank at a location for immersion of at least part of the fan housing within the tank liquid, said fan housing thereby serving as a heat exchange housing enhancing the transfer of thermal energy from the gaseous combustion products through the blower fan housing to the liquid in the tank and minimizing possible high temperature damage to the blower means, noise, and danger to nearby personnel.

11. Apparatus according to claim 10 having means providing a condensation drain extending from the blower fan housing to the outside of the tank.

12. Apparatus according to claim 10 in which the blower fan housing is at one end of a generally cylindrical horizontal blower support housing which has an open outer end projecting axially out of the tank, said support housing having an axially and outwardly removable transverse blower support plate extending across the blower support housing within the tank and serving as an outer front wall for the blower fan housing, securing means accessible through the outer open end of the blower support housing for removably holding the transverse support plate in air-tight engagement within the cylindrical blower support housing, a fan motor secured to the transverse blower support plate within the open end of the blower support housing and having a driving shaft extending axially toward the transverse blower support plate, a rotary blower fan located in the fan housing inwardly of the transverse blower support plate and having a driving connection through such transverse plate with the motor shaft, and a breeching plate extending transversely across the inner end of the blower fan housing and having an axial inlet opening, the flue assembly including a flue member positioned to deliver gaseous combustion products to said blower fan axial inlet opening, and said blower fan housing having a tangential outlet opening for discharging the combustion products out through the exhaust stack.

13. Apparatus according to claim 12 in which the flue member connected to the blower fan inlet housing is an unobstructed U-shaped tube member with upper and lower parallel open ends extending transversely across the tank for heat-exchange immersion in the tank liquid and with the upper open end extending axially of the blower fan housing to the fan housing inlet in the breeching plate, thereby providing convenient cleaning and maintenance access to the U-shaped flue tube member by selective removal of the blower support plate, motor and fan through the outer open end of the blower support cylinder.

14. Apparatus according to claim 10 in which the tank is a combination liquid heating and storage tank of substantial capacity for containing a large volume, such as more than 1,000 gallons, of liquid to be heated therein and stored for periods up to several days between intermittent burnings of fuel, said tank having a constantly open venting means connecting the top of the tank at all times to ambient atmospheric pressure outside the tank, and in which the firebox is a solid-fuel-burning firebox supported within the tank at a location for substantially complete immersion within the tank liquid except for an externally exposed firebox door.

15. In a liquid heating apparatus having a tank for heated liquid, a solid-fuel-burning liquid tight firebox having (a) an open fuel-loading end accessible outside the tank, and (b) a firebox body portion including top, bottom and side walls extending from said open end to an opposite end wall, said firebox being supported at a location providing direct heat transfering engagement between a substantial area of at least one of its top, bottom, side and opposite end wall portions and the tank liquid to be heated, a firebox door for selectively opening and closing the firebox open end, an exhaust stack extending outwardly from the tank, and a flue assembly extending from the firebox through the liquid in the tank to the exhaust stack, the improvement in which the firebox includes heat transfer limiting means for minimizing excessive heat transfer from the high combustion temperatures within the firebox to the adjacent liquid in the tank while maintaining the high combustion temperatures required for efficient solid fuel combustion, and in which the heat transfer limiting means comprises a removable inner low-mass liner providing a combustion chamber inner wall spaced inwardly from the liquid engaging firebox wall area and defining a heat-transfer limiting air space between them, in which the firebox body portion is located for substantially complete immersion within the tank liquid, in which the firebox and liner are generally coaxial and define a heat-transfer limiting airspace extending substantially from the firebox door to the opposite end of the liner, the liner having a transverse end wall spaced inwardly from the firebox opposite end wall and defining a further air space between said firebox and liner end walls, in which the liner is removably supported within the firebox for selective removal and insertion through the open outer firebox end when the firebox door is open, and in which the firebox and low-mass liner have cylindrical coaxial body portions defining the heat-transfer limiting air space as an annular air space therebetween, the liner having a radial outwardly projecting flange at its firebox door end with an outer flange diameter slightly less than the inner diameter of the firebox, thereby providing a limiting annular air inlet from the outer end of the combustion chamber around the firebox door end of the liner and into the annular air space, said liner having a wall portion defining a secondary reaction chamber through which gaseous combustion products must pass before they enter the flue assembly, said liner having an opening for feeding air from the annular air space to the secondary reaction chamber, and said liner and secondary reaction chamber wall portion being removable as a unit through the firebox open end housing.

16. A combination solid-fuel burning liquid heating and thermal energy storage apparatus for storing heated liquid at temperatures suitable for the heating of room spaces and other uses during intervals of up to several days between intermittent burnings of successive fuel loads, said apparatus comprising a storage tank of substantial capacity having top, bottom, front, back, and side tank wall portions for containing a large volume of liquid, such as more than 1,000 gallons, to be heated and stored therein, the front wall portion having a single firebox opening therein spaced above the bottom tank wall portion, a liquid-tight firebox fixed within said tank and having an open outer fuel-loading end accessible through the firebox opening, means providing liquid-tight engagement between the outer firebox end and the tank wall portion around the firebox opening, a firebox door member for selectively opening and closing said firebox open end, said firebox also having a main body portion within the tank including top, bottom, and side firebox wall portions and an inner firebox end wall portion opposite the outer firebox end, means supporting the firebox at a level above the bottom tank wall portion within the tank for substantially complete immersion of said firebox top, bottom, side and inner end wall portions within the tank liquid, means constantly venting the top of said storage tank to ambient pressure outside the tank and thereby holding the maximum tank liquid temperature close to the liquid boiling point at such ambient pressure and preventing increases of the internal tank pressure and external tank temperatures above safe levels with respect to any immediately adjacent building walls, an exhaust stack member extending outwardly from the inside to the outside of the tank, a flue assembly within the tank comprising at least one flue member extending circuitously through the tank liquid, the flue assembly having a flue inlet connected to receive gaseous combustion products from the firebox, a flue outlet connected to the exhaust stack, and heat transfer enhancing means for increasing the effective heat transfer from gaseous combustion products in the flue assembly to the liquid in such tank, said heat transfer enhancing means comprising at least one abrupt direction-changing, turbulence-generating heat exchange housing immersed in the tank liquid and having an inlet and an outlet serially connected in the flue assembly between the firebox and final exhaust stack, and blower means connected to at least one of said exhaust stack and flue assembly members for drawing a supply of combustion air into the firebox outer end and firebox, drawing the gaseous combustion products out of the firebox into the flue assembly and providing a forced discharge of such combustion products out of the exhaust stack during the burning of each successive fuel load, in which said flue assembly includes one flue tube member having an inlet end connected to receive combustion products from the firebox and an outlet end extending within the tank liquid toward one wall of the tank and a second flue tube member having an inlet end extending within the tank liquid toward the same wall of the tank parallel to and close to the outlet end of said one flue tube member, and in which one immersed turbulence-generating, heat exchange housing extends transversely from said one flue tube member outlet end to said second flue member inlet end, thereby providing an abrupt direction-reversing chamber for the gaseous combustion products entering the heat exchange housing from said one flue tube member outlet end and leaving said housing in a reverse parallel direction through said second flue tube member inlet end, in which said one wall of the tank has means for selective access to the respective first and second flue tube outlet and inlet ends for convenient cleaning of said flue tube members without substantial disassembly of such flue tube members from the flue assembly and tank, and in which the firebox includes a low mass heat transfer limiting means for minimizing excessive heat transfer from the combustion temperatures within the firebox to the surrounding liquid within the tank while maintaining the high firebox temperatures required for efficient solid fuel combustion with minimal production of pollutants, the heat transfer enhancing means of the flue assembly in said apparatus also including a further abrupt direction-changing, turbulence-generating, heat exchange housing immersed in the tank liquid, said further heat exchange housing comprising a rotary blower fan housing having an axial inlet and a tangential outlet, and in which said blower means includes a rotary fan in said rotary blower housing and motor means outside the tank connected through a tank wall portion for driving said rotary fan, thereby enhancing the transfer of thermal energy from the gaseous combustion products through the blower fan housing to the liquid in the tank and minimizing possible high temperature damage to the blower means, noise, and danger to nearby personnel.

17. Apparatus according to claim 16 in which the firebox door member has inner and outer generally parallel walls, each extending transversely fully across the fuel-loading open end and spaced from each other to provide a coextensive air space between them, the inner wall having an air nozzle opening through which a supply of combustion air can enter the firebox from said air space, the outer wall having an air inlet opening through which such combustion air can initially enter said air space and be preheated by sweeping contact with the inner door wall before it passes through the nozzle opening, and a radiation shield supported in the space between the inner door wall air nozzle opening and the outer door wall, said radiation shield having a shape and area shielding the outer door wall from direct radiation outwardly through the air nozzle opening from a fire within the firebox.

* * * * *